US006474661B1

(12) United States Patent
Chang

(10) Patent No.: US 6,474,661 B1
(45) **Date of Patent: *Nov. 5, 2002**

(54) BASE STRUCTURE FOR ROLLER SKATES

(76) Inventor: Chun-Cheng Chang, No. 492-16, Chia-Li Hsing, Chia-Li Chen, Tainan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/666,454

(22) Filed: Sep. 21, 2000

(30) Foreign Application Priority Data

Sep. 23, 1999 (EP) ..... 99118743

(51) Int. Cl.[7] ..... A63C 17/00

(52) U.S. Cl. ..... 280/11.19; 280/7.13; 280/11.25; 280/11.27

(58) Field of Search ..... 280/11.19, 841, 280/11.27, 11.204, 11.221, 11.223, 7.13, 9; 36/115

(56) References Cited

U.S. PATENT DOCUMENTS

| | | | | | |
|---|---|---|---|---|---|
| 2,095,942 | A | * | 10/1937 | Wetterstrand | 36/2.5 |
| 3,152,812 | A | * | 10/1964 | Cummings | 280/11.19 |
| 3,884,485 | A | * | 5/1975 | Walle | 280/841 |
| 3,979,842 | A | * | 9/1976 | Texidor | 36/115 |
| 3,983,643 | A | * | 10/1976 | Schreyer et al. | 36/115 |
| 4,333,249 | A | * | 6/1982 | Schaefer | 36/115 |
| 4,372,566 | A | * | 2/1983 | Smith | 280/11.19 |
| 4,442,614 | A | * | 4/1984 | Farberov | 36/103 |
| 4,928,982 | A | * | 5/1990 | Logan | 280/11.22 |
| 5,312,120 | A | | 5/1994 | Wiegner | 280/11.2 |
| 5,398,970 | A | * | 3/1995 | Tucky | 280/841 |
| 5,511,824 | A | * | 4/1996 | Kim | 280/841 |
| 5,785,327 | A | * | 7/1998 | Gallant | 280/11.27 |
| 5,797,609 | A | * | 8/1998 | Fichepain | 280/11.19 |
| 5,803,469 | A | * | 9/1998 | Yoham | 280/11.27 |
| 5,882,018 | A | * | 3/1999 | Petrosino | 280/7.13 |

(List continued on next page.)

FOREIGN PATENT DOCUMENTS

| | | |
|---|---|---|
| DE | 197 55 340 A1 | 6/1999 |
| DE | 198 01 996 A1 | 7/1999 |
| WO | WO 00/16862 | 3/2000 |

*Primary Examiner*—Brian L. Johnson
*Assistant Examiner*—Bridget Avery
(74) *Attorney, Agent, or Firm*—Bacon & Thomas

(57) ABSTRACT

A base structure for a roller skate includes a base having at least two compartments, a bottom plate secured to the base, and a number of wheel assemblies each of which is mounted in an associated compartment. The bottom plate includes a number of blocks formed on the underside thereof, each block being received in an associated compartment. Each wheel assembly includes a pivotal seat having a first end secured to the underside of the bottom plate, a wheel seat having a first end pivotally connected to a second end of the pivotal seat, and a wheel rotatably mounted to a second end of the wheel seat. Each wheel seat may be pivoted to a storage position in the associated compartment when not in use. When skating is required, each wheel seat is pivoted to an operative position, in which each wheel seat bears against an underside of an associated block while the wheel rotatably attached to each wheel seat extends beyond the base for skating. Furthermore, the base structure for a roller skate also includes a first elastic member has a first end attached to the pivotal seat and a second end attached to a mounting member on the wheel for biasing the wheel seat to a storage position in the base. A stopping member includes a first end mounted to the pin and a second end through which the mounting member is extended. A second elastic member is mounted around the pin for biasing a stop of the stopping member to a position for releasably engaging with the wheel seat to prevent the wheel seat from moving into the storage position in the base when the wheel seat and the wheel are extended beyond the base for skating.

2 Claims, 11 Drawing Sheets

U.S. PATENT DOCUMENTS 5,887,898 A * 3/1999 Petrosino ..... 280/825
6,042,125 A * 3/2000 Wu ..... 280/11.27
6,065,759 A 5/2000 Wu ..... 280/11.115
6,120,039 A * 9/2000 Clementi ..... 280/11.19
6,247,708 B1 6/2001 Hsu ..... 280/11.223
6,308,964 B1 * 10/2001 Chang ..... 280/11.19
6,328,318 B1 12/2001 Hsu ..... 280/11.223
6,336,644 B1 1/2002 Chu ..... 280/11.233

* cited by examiner

BASE STRUCTURE FOR ROLLER SKATES

BACKGROUND OF THE INVENTION

1. Field of the Invention

The present invention relates to a base structure for roller skates.

2. Description of the Related Art

The wheels of a typical roller skate are fixed to an underside of the roller skate, and the user has to wear a pair of shoes (generally sport shoes) before putting the roller skates on. The user cannot walk on rugged surfaces when wearing the roller skates. Thus, the user faces troublesome actions of putting on and taking off of the roller skates when he/she starts or stops skating.

Taiwan Utility Model Publication No. 339688 issued on Sep. 1, 1998 discloses a roller skate includes a base and a number of wheels that can be pivoted to storage positions in the base such that the user may directly walk through rugged surfaces without troublesome actions of taking off and re-putting on of the roller skates. However, as shown in FIG. 1 of the drawings, the base 1 includes a number of shoulder sections 2 to which the wheel seats 3 may bear against. The shoulder sections 2 and the overall base 1 must be made of rigid material to support the user. As a result, the user feels uncomfortable when standing on the rigid base. In addition, the wheel assemblies are mounted to the base 1 via an interior of an upper 4 that limits assembly of the wheel assemblies.

Furthermore, when walking on an inclined surface, one of the wheel seats 3 might be pivoted into the storage compartment 4 in the base 1. The wheel seats 3 might also be pivoted into the storage compartments 4 if they impinge objects on the ground. The skater might be injured as a result of losing balance.

The present invention is intended to provide a base structure for roller skates that mitigates and/or obviates the above problems.

SUMMARY OF THE INVENTION

It is a primary object of the present invention to provide a base structure for roller skates in which the wheels may be stored in the base structure, and assembly of the base structure is easy to accomplish.

It is another object of the present invention to provide a base structure for roller skates that causes no uncomfortable feeling to the user during wearing.

It is another object of the present invention to provide a roller skate having two wheel assemblies that can be moved to the storage positions when not in use and that can be retained in operative statuses when skating.

A base structure for a roller skate in accordance with the present invention comprises a base having at least two compartments, a bottom plate secured to the base, and a corresponding number of wheel assemblies each of which is mounted in an associated compartment. The bottom plate includes a number of blocks formed on the underside thereof, each block being received in an associated compartment. Each wheel assembly includes a pivotal seat having a first end secured to the underside of the bottom plate, a wheel seat having a first end pivotally connected to a second end of the pivotal seat, and a wheel rotatably mounted to a second end of the wheel seat. Each wheel seat may be pivoted to a storage position in the associated compartment when not in use. When skating is required, each wheel seat is pivoted to an operative position, in which each wheel seat bears against an underside of an associated block while the wheel rotatably attached to each wheel seat extends beyond the base for skating.

The base may be made of resilient and shock-absorbing material as the base merely accommodates the wheel assemblies. In addition, assembly of the base structure can be finished before attaching the shoe upper to avoid assembly of the wheel assemblies via the interior of the shoe upper.

A base structure for a roller skate in accordance with the present invention comprises:

- a pivotal seat having a first end secured to a base of the roller skate and a second end,
- a wheel seat having a first end pivotally connected to the second end of the pivotal seat by a pin and a second end;
- a wheel rotatably mounted to the second end of the wheel seat, the wheel seat further including a mounting member;
- a first elastic member having a first end attached to the pivotal seat and a second end attached to the mounting member of the wheel seat for biasing the wheel seat to a storage position in the base;
- a stopping means including a first end mounted to the pin and a second end through which the mounting member is extended, the stopping means further including a stop; and
- a second elastic member mounted around the pin for biasing the stop of the stopping means to a position for releasably engaging with the wheel seat to prevent the wheel seat from moving into the storage position in the base.

By such arrangement, the wheel seat may be moved into the base when not skating. When skating is required, the wheel seat and the wheel are extended beyond the base, and the stop may prevent the wheel seat from entering the base during skating, thereby preventing potential injury to the skater.

Other objects, advantages, and novel features of the invention will become more apparent from the following detailed description when taken on conjunction with the accompanying drawings.

DETAILED DESCRIPTION OF THE PREFERRED EMBODIMENTS

Figure 1:
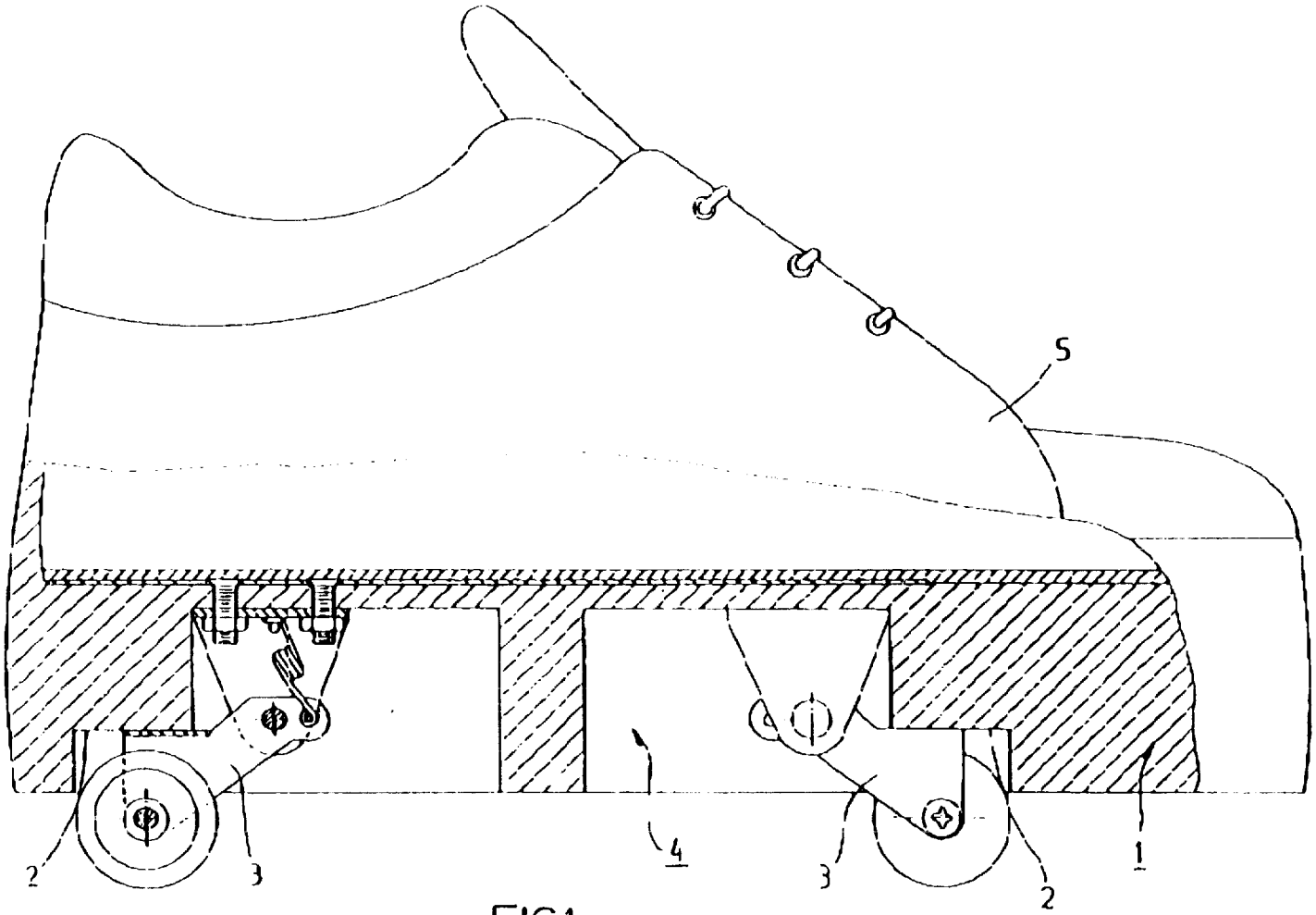
FIG1 PRIOR ART
FIG. 1 is a side view, partially sectioned, of a conventional roller skate.
Figure 2:
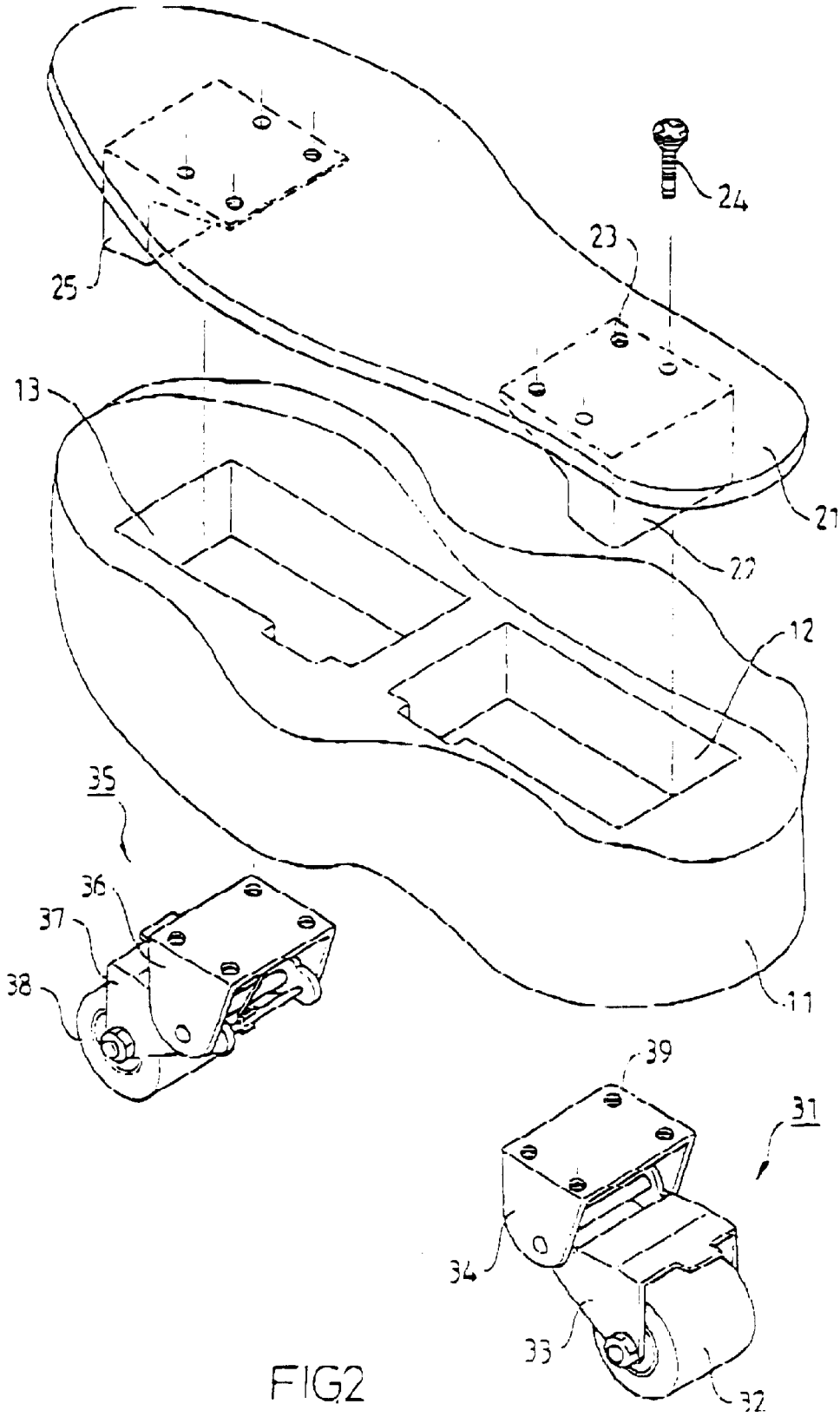
FIG. 2 is an exploded perspective view of a roller skate in accordance with the present invention.
Figure 3:
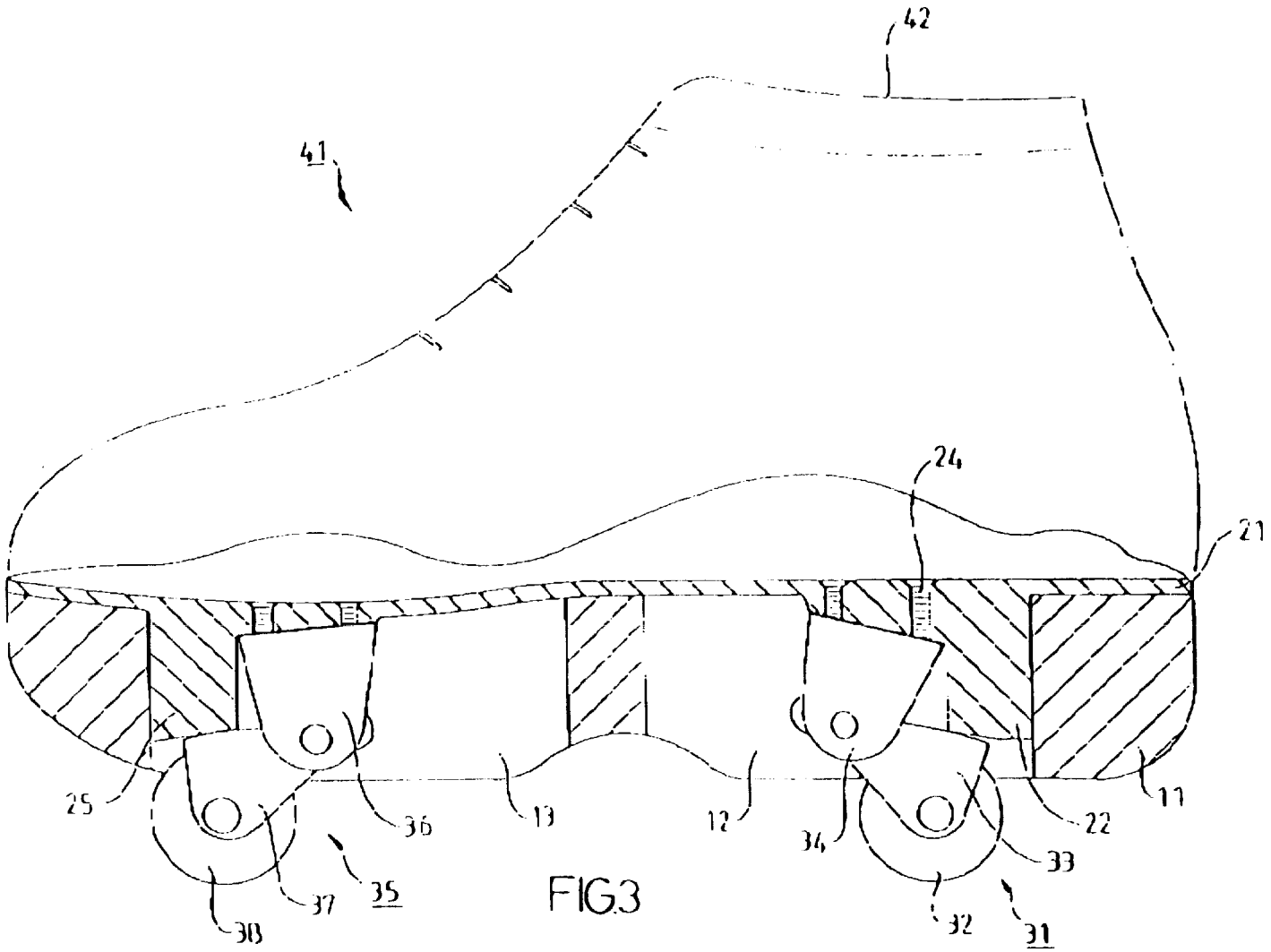
FIG. 3 is a side view, partially sectioned, of the roller skate in accordance with the present invention, wherein the wheels are in operative positions.

Referring to FIGS. 2 and 3, a roller skate in accordance with the present invention generally includes a base or sole 11 having two compartments 12 and 13 defined therein, a bottom plate 21 mounted to an upper side of the base 11, and two wheel assemblies 31 and 35 attached to an underside of the bottom plate 21. As can be seen from FIG. 3, the compartment 12 receives the wheel assembly 31, while the compartment 13 receives the wheel assembly 35.

The bottom plate 21 includes two blocks 22 and 25 formed on the underside thereof and a number of positioning holes 23. Each wheel assembly 31, 35 includes a pivotal seat 34, 36 having a first end attached to the underside of the bottom plate 21 by means of extending fasteners (e.g., bolts 24) through associated positioning holes 23 in the bottom plate 23 and positioning holes 39 in the pivotal seat 34, 36. Each pivotal seat 34, 36 further includes a second end to which and end of a wheel seat 33, 37 is pivotally connected. The other end of each wheel seat 33, 37 includes a wheel 32 rotatably mounted thereto.

In assembly, the pivotal seats 34 and 36 are attached to the underside of the bottom plate 21 by the bolts 24, and the bottom plate 21 is then secured to the base 11 by e.g., an adhesive agent. The base structure of the present invention can be attached to an upper 41 after assembly of the base structure of the present invention. The upper 41 includes an interior 42 for receiving a foot of the user.

Figure 4:
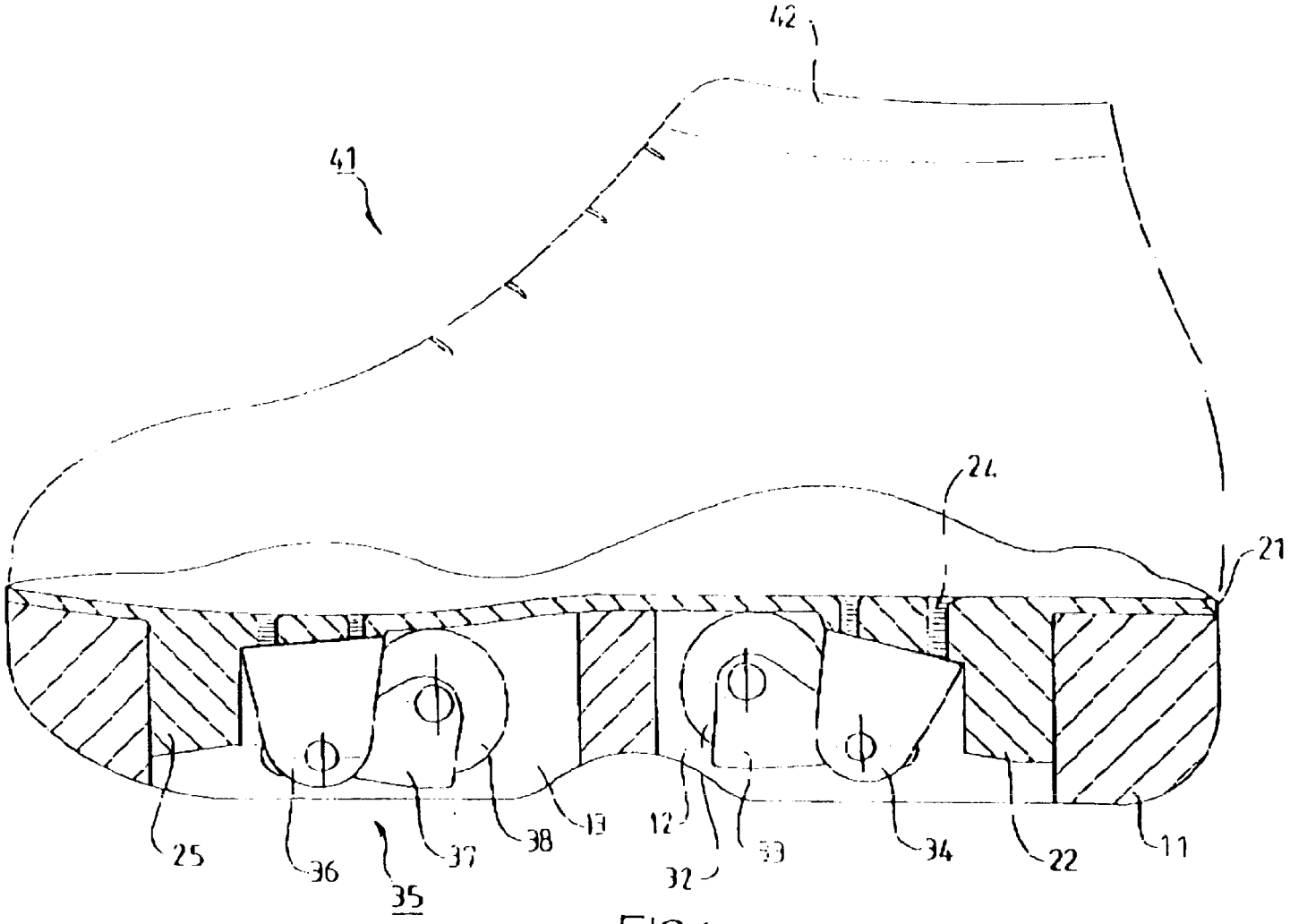
FIG. 4 is a side view similar to FIG. 3, wherein the wheels are in storage positions.

When the wheel seats 33 and 37 are pivoted to extend beyond the base 11, the wheel seats 33 and 37 bear against undersides of the blocks 22 and 25, respectively. Thus, the roller skate may perform its skating function, as shown in FIG. 3. When the wheel seats 33 and 37 are pivoted to the storage positions shown in FIG. 4, the roller skate can be used as a normal shoe such that the user may walk through rugged roads or surfaces.

The bottom plate 21 and the blocks 22 and 25 are made of rigid material (e.g., semi-rigid plastic material) to reliably support the skater during skating. The base 11 may be made of resilient and shock-absorbing material as the base 11 merely accommodates the wheel assemblies 31 and 35.

Figure 5:
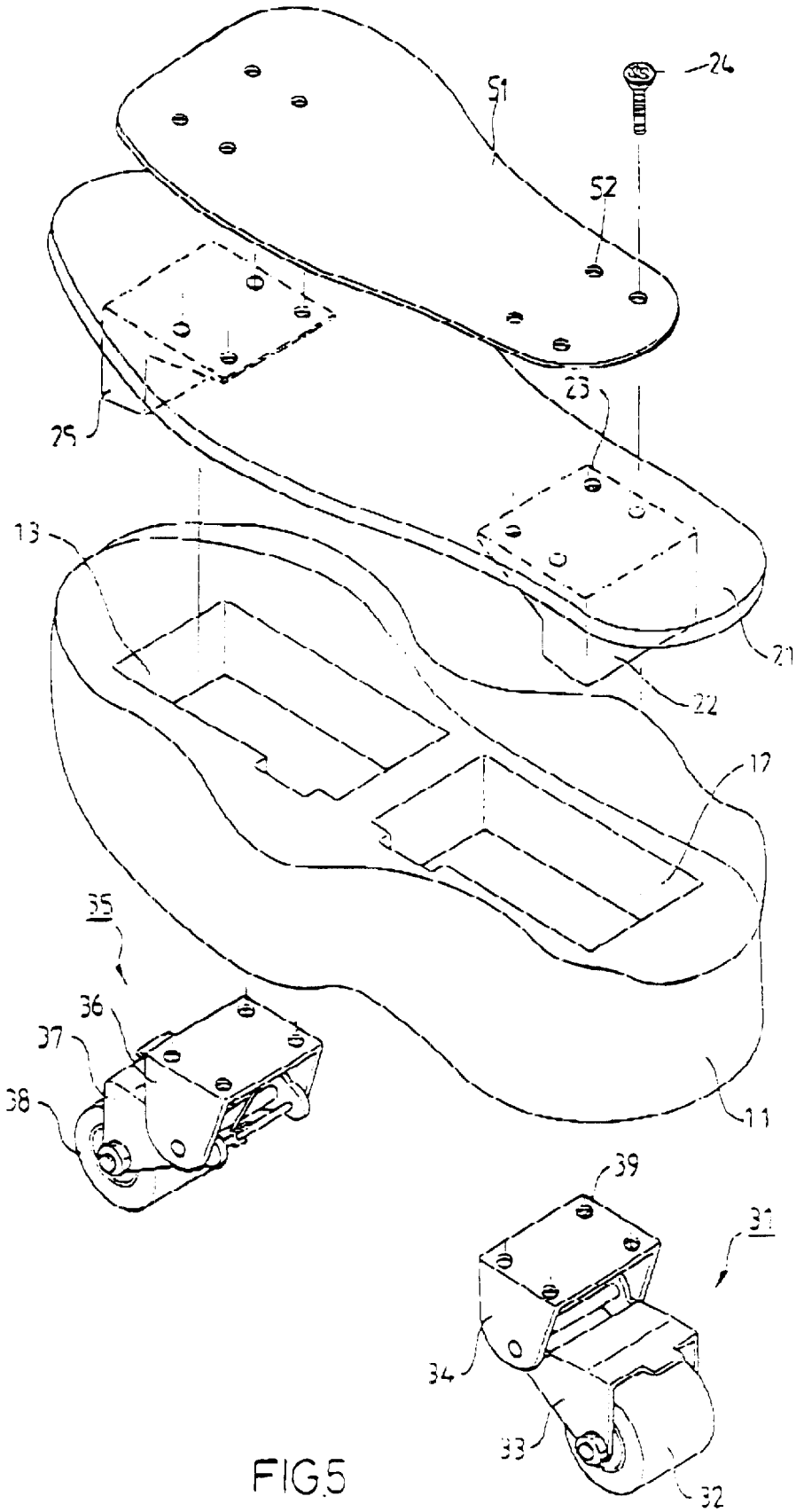
FIG. 5 is an exploded perspective view of another embodiment of the roller skate in accordance with the present invention.
Figure 6:
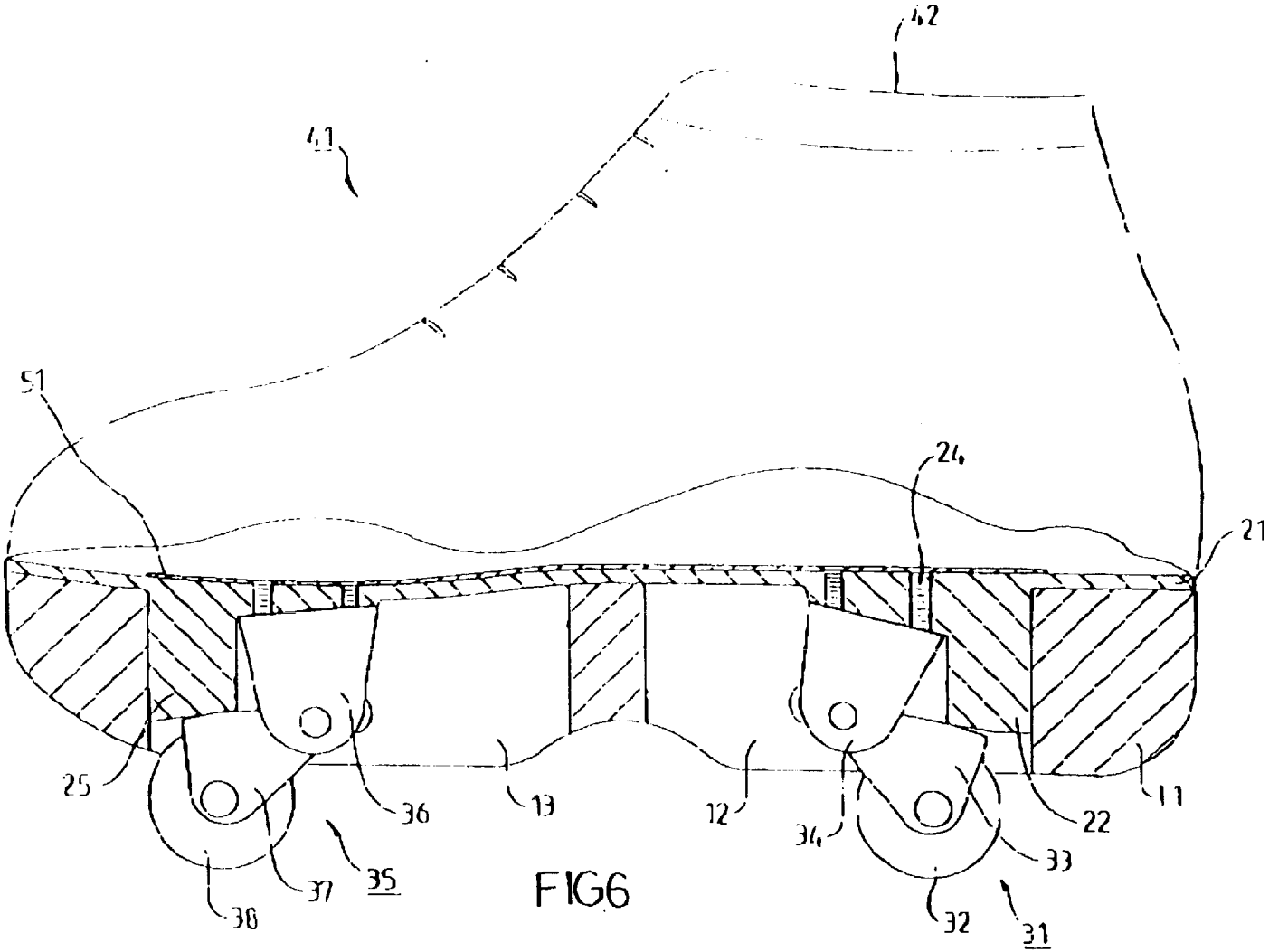
FIG. 6 is a side view, partially sectioned, of the roller skate in FIG. 5.

FIGS. 5 and 6 illustrate another embodiment of the invention, wherein a reinforcing plate 51 is secured to an upper side of the bottom plate 21 by means of extending the screws 24 through positioning holes 52 in the reinforcing plate 51. The reinforcing plate 51 is made of rigid material, e.g., metal to provide additional support for the pivotal seats 34 and 36.

According to the above description, it is appreciated that the base structure for roller skates in accordance with the present invention may completely accommodate the wheel assemblies when not skating such that the base may be made of resilient and shock-absorbing material to provide a comfortable wearing for the user. In addition, the base structure may be assembled before attaching to an upper. The assembly procedure is easier.

Figure 7:
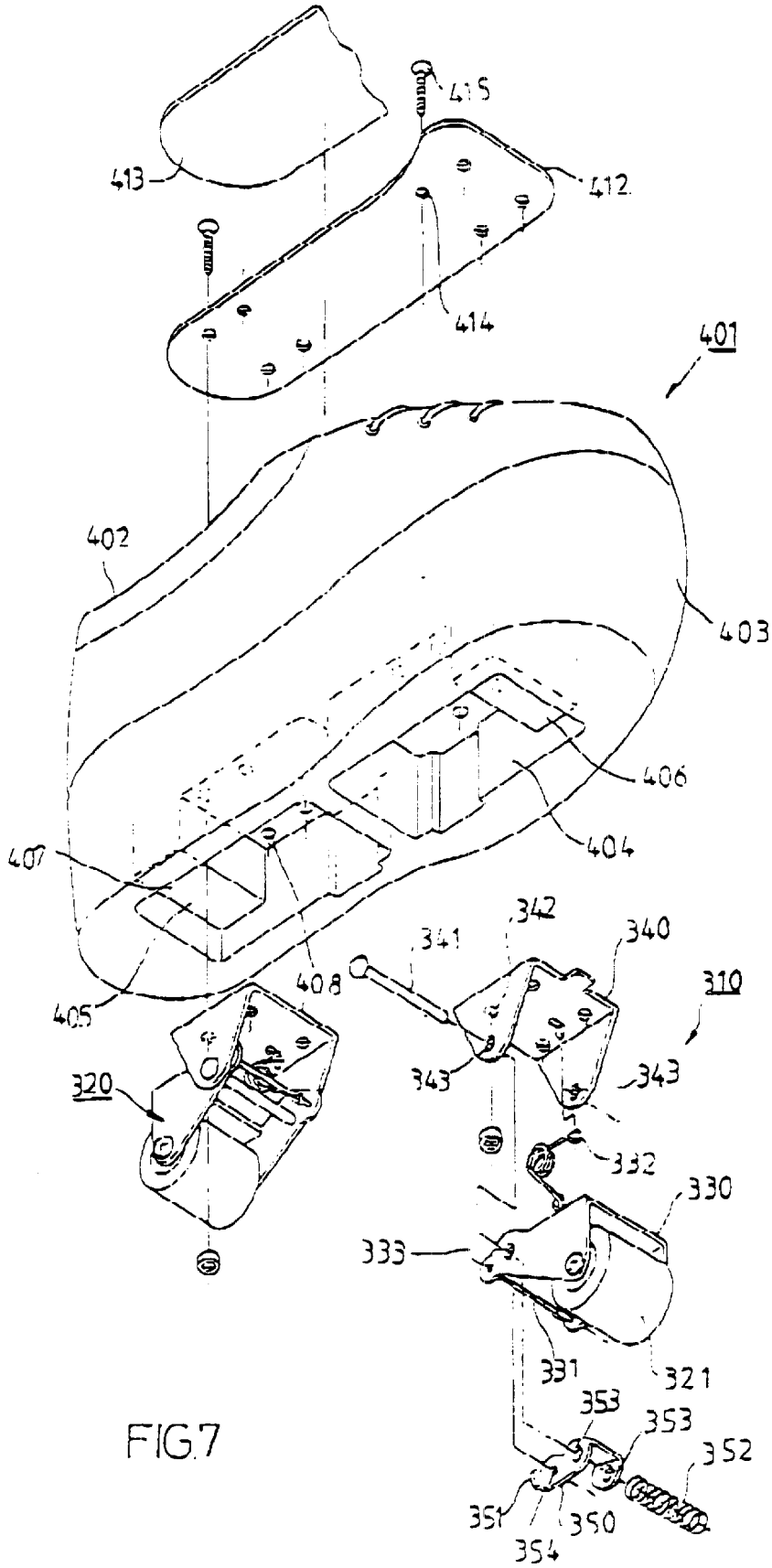
FIG. 7 is an exploded perspective view of another embodiment in accordance with the present invention.
Figure 8:
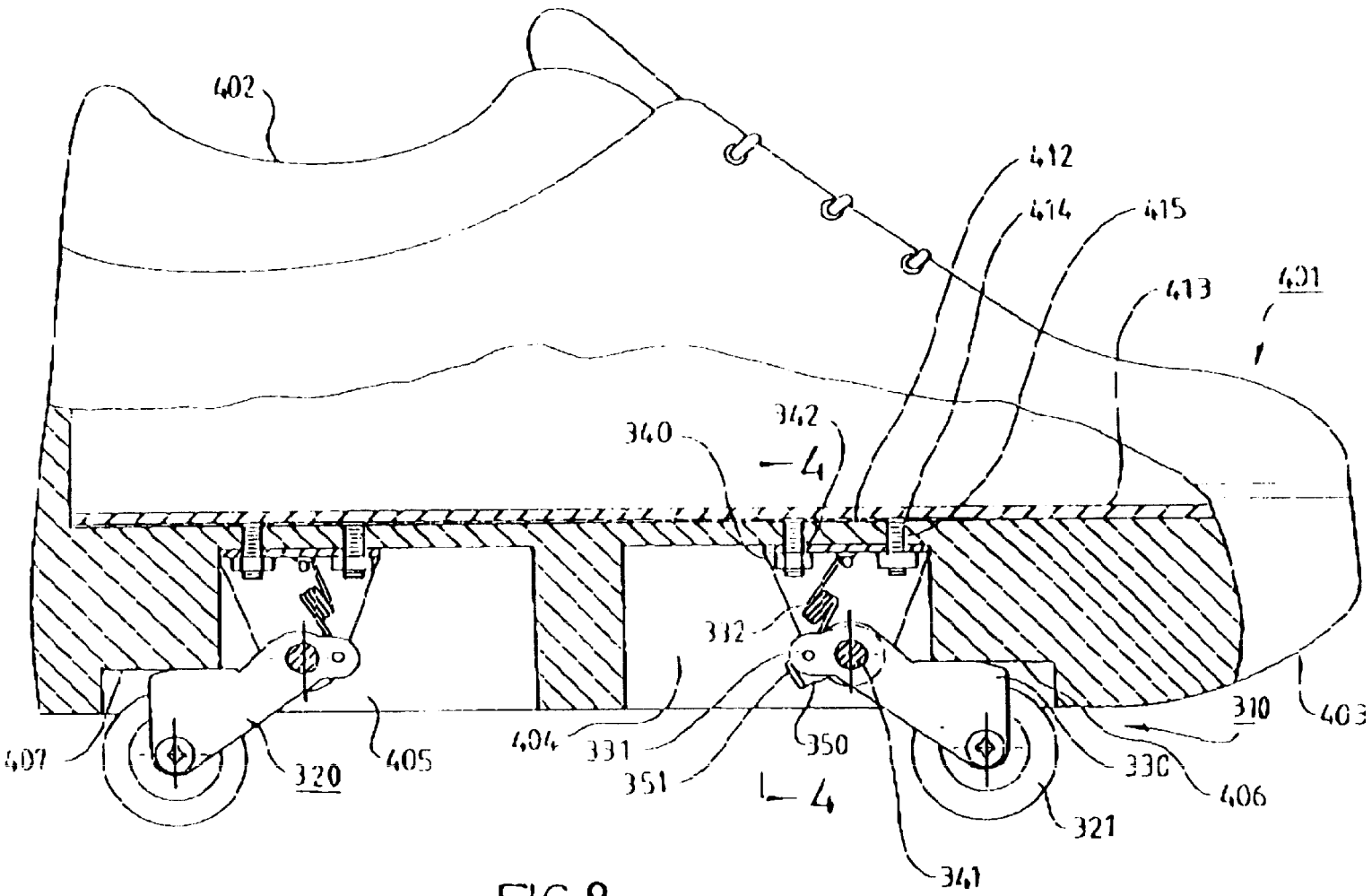
FIG. 8 is a side view, partially sectioned, of the roller skate in FIG. 7, wherein the wheels are in operative positions.

Referring to FIGS. 7 and 8, a roller skate of another embodiment in accordance with the present invention generally includes a base or sole 403 having two compartments 404 and 405 defined therein, a bottom plate 412 mounted to an upper side of the base 403, two wheel assemblies 310 and 320 attached to an underside of the bottom plate 403, and a stopping means 350. As can be seen from FIG. 8, the compartment 404 receives the wheel assembly 310, while the compartment 405 receives the wheel assembly 320. The base 403 further includes two shoulders 406 and 407 defined in the compartments 404 and 405, respectively.

A soft padding plate 413 may be provided on top of the bottom plate 412. An upper 401 is attached to the base 403 and includes an interior 402 for receiving the foot of the skater, which is conventional and therefore not further described.

The bottom plate 412 includes a number of positioning holes 414. Each wheel assembly 310, 320 includes a pivotal seat 340 having a first end attached to the underside of the base 403 by means of extending fasteners (e.g., bolts 415) through associated positioning holes 414 in the bottom plate 412, positioning holes 408 in the base 403, and positioning holes 342 in the pivotal seat 340. Each pivotal seat 340 further includes a second end to which an end of a wheel seat 330 is pivotally connected by means of extending a pin 341 through holes 343 in the pivotal seat 340 and holes 333 in the wheel seat 330. The other end of each wheel seat 330 includes a wheel 321 rotatably mounted thereto. An elastic member, e.g., a torsion spring 332 is attached between the pivotal seat 340 and a mounting member 331 on the wheel seat 330 for biasing the wheel seat 330 to its storage position in the associated compartment 404, 405.

The stopping means 350 includes a first end pivotally connected to the pin 341 (by means of extending the pin 341 through holes 353 in the stopping means 350) and a second end with a hole 354 through which the mounting member 331 extends. The stopping means 350 further includes a stop 351. A further elastic member, e.g., a coil spring 353 is mounted around the pin 341 and attached between the first end of the stopping means 350 and the wheel seat 330 (FIG. 10).

Figure 9:
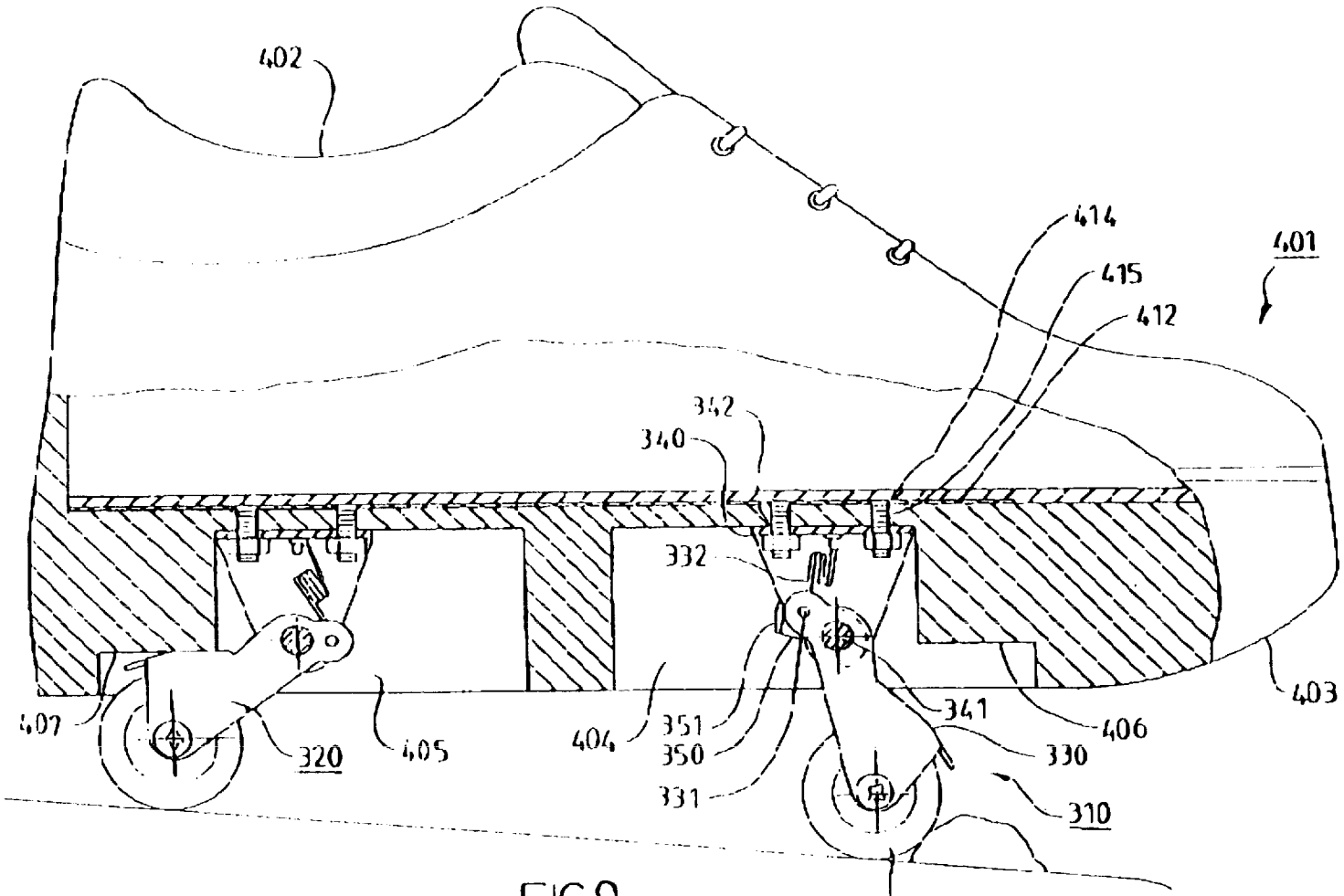
FIG. 9 is a side view similar to FIG. 8, wherein the roller skate is passing through a decline.

When the wheel seats 330 are pivoted to extend beyond the base 403, the wheel seats 330 bear against the shoulders 406 and 407, respectively. Thus, the roller skate may perform its skating function, as shown in FIG. 8. Referring to FIG. 9, when skating on a decline, the front wheel seat 310 moves away from the shoulder 406 and pivots through an angle until the stop 351 of the stopping means 330 engages with and is thus stopped by the pivotal seat 340. thereby preventing further pivotal movement of the wheel seat 330, as shown in FIG. 10. Thus, the wheel seat 330 will not move into its storage compartment 404, i.e., the wheel seat 330 is retained in its operative status for skating to thereby avoid potential injury to the skater.

Figure 10:
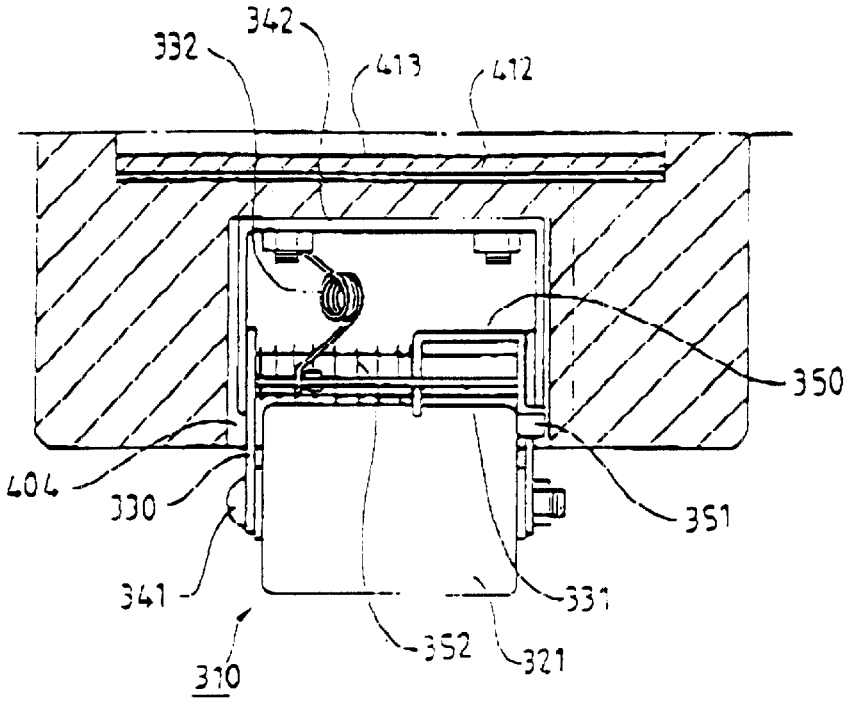
FIG. 10 is a cross sectional view illustrating operation of a stopping means of the roller skate in FIG. 7.
Figure 11:
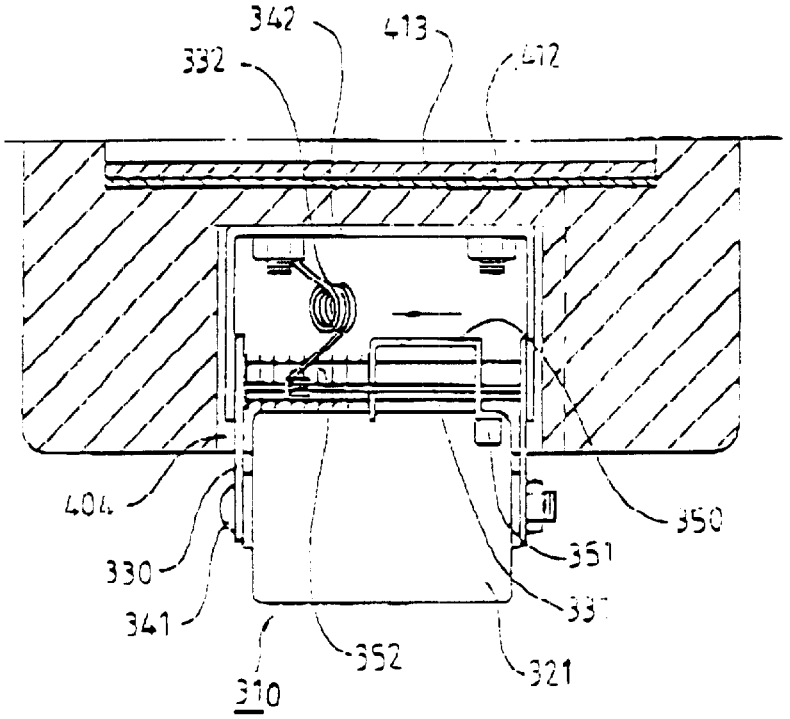
FIG. 11 is a view similar to FIG. 10, wherein the stopping means is in a status allowing the wheel seat to move to a storage position.
Figure 12:
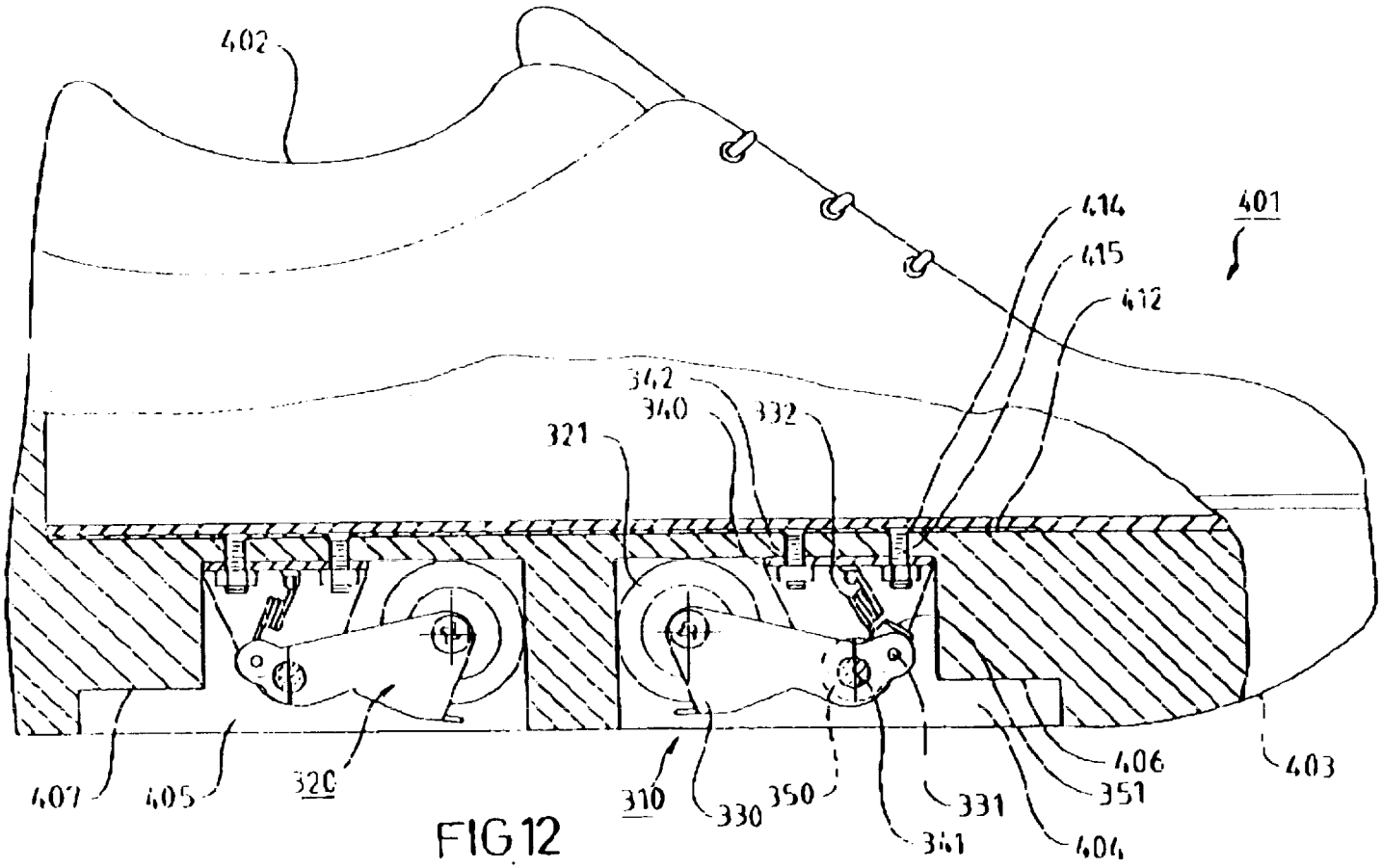
FIG. 12 is a side view similar to FIG. 8, wherein the wheels are in storage positions.

As can be seen from FIG. 10, the stopping means 350 is biased by the elastic member 352 toward a side of the wheel seat 330 such that the stop 351 may bears against the pivotal seat 340 to prevent movement of the wheel seat 330 into the compartment 404. Referring to FIG. 11, when not skating, the stopping means 350 may be moved axially away from the side of the wheel seat 330 such that the wheel seat 330 may move into the compartment 404 under the action of the elastic member 332, as the stop 351 is not on the way of the wheel seat 330 into the compartment 404. As a result, the wheel seats are moved into the storage positions when not skating, as shown in FIG. 12. Thus, the roller skate can be used as a normal shoe.

According to the above description, it is appreciated that the wheel seats in accordance with the present invention may be received in the compartments in the base when not skating, and the wheel seats are prevented from entering into the compartments when skating, thereby preventing potential injury to the skater.

Although the invention has been explained in relation to its preferred embodiment, it is to be understood that many other possible modifications and variations can be made without departing from the spirit and scope of the invention as hereinafter claimed.

What is claimed is:

1. A wheel assembly for a roller skate having a base (403), the wheel assembly comprising:

a pivotal seat (340) having a first end secured to the base (403) and a second end;

a wheel seat (330) having a first end pivotally connected to the second end of the pivotal seat (340) and a second end;

a wheel (321) rotatably mounted to the second end of the wheel seat (330);

a stopping means (350) including a stop (351); and an elastic member (352) being adapted to bias the stop (351) of the stopping means (350) to a position for releasably engaging with the wheel seat (330) to prevent said wheel seat from moving to a storage position into a singular cavity of the base (403) or moving to an operative position out of the base (403).

2. A wheel assembly for a roller skate having a base, the wheel assembly comprising:

a pivotal seat having a first end secured to the base and a second end;

a wheel seat having a first end pivotally connected to the second end of the pivotal seat and a second end;

a wheel rotatably mounted to the second end of the wheel seat;

a stop which engages an elastic member, said elastic member being adapted to bias the stop to a position for releasably engaging with the wheel seat to prevent said wheel seat from moving to a storage position into the base.

* * * * *